US008313618B2

(12) United States Patent
Binder et al.

(10) Patent No.: US 8,313,618 B2
(45) Date of Patent: Nov. 20, 2012

(54) SCREENING IN AN APPROACH FLOW SYSTEM

(75) Inventors: Erwin Binder, Heidenheim (DE); Christian Bangert, Heidenheim (DE); Hubert Stojanovic, Meckenbeuren (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/157,904

(22) Filed: Jun. 10, 2011

(65) Prior Publication Data

US 2011/0290444 A1 Dec. 1, 2011

Related U.S. Application Data

(63) Continuation of application No. PCT/EP2009/064526, filed on Nov. 3, 2009.

(30) Foreign Application Priority Data

Dec. 12, 2008 (DE) ..... 10 2008 061 970

(51) Int. Cl.
*D21H 23/00* (2006.01)

(52) U.S. Cl. ..... 162/380

(58) Field of Classification Search ..... 162/380, 162/274, 55; 209/240, 270, 306; 210/298, 210/415

See application file for complete search history.

(56) References Cited

U.S. PATENT DOCUMENTS

| | | | |
|---|---|---|---|
| 6,086,718 | A | 7/2000 | Carter et al. |
| 2008/0006580 | A1 | 1/2008 | Jaeger et al. |

FOREIGN PATENT DOCUMENTS

| | | | |
|---|---|---|---|
| DE | 198 59 770 | A1 | 12/1999 |
| DE | 100 50 109 | A1 | 4/2002 |
| DE | 102 34 559 | A1 | 2/2004 |
| DE | 10 2004 049 261 | A1 | 4/2006 |
| DE | 10 2006 030 905 | B3 | 7/2007 |
| DE | 10 2006 036 018 | B3 | 1/2008 |
| DE | 10 2008 061 970 | A1 | 6/2010 |
| EP | 0 029 905 | A1 | 6/1981 |
| EP | 1 262 594 | A1 | 12/2002 |
| EP | 1 645 684 | A1 | 4/2006 |
| WO | 8302293 | A1 | 7/1983 |

OTHER PUBLICATIONS

EP 1262 594, Bezler et al., machine translation, May 2001.*
International Search Report dated Jul. 4, 2011 for PCT/EP2009/064526 (2 pages).
International Preliminary Report on Patentability dated Sep. 6, 2011 for PCT/EP2009/064526 (6 pages).
Written Opinion of the International Searching Authority (undated) for PCT/EP2009/064526 (5 pages).
German Search Report dated Sep. 28, 2009 for DE 10 2008 061 970.1 (4 pages).

* cited by examiner

*Primary Examiner* — Mark Halpern
(74) *Attorney, Agent, or Firm* — Taylor IP, P.C.

(57) ABSTRACT

The invention relates to an arrangement for obtaining a fiber suspension for producing a web of paper, cardboard, tissue, or other fibers from at least one high-consistency flow containing fibrous material and filling material in the approach flow system of a fiber web manufacturing machine, at least one high-consistency flow being directed through at least one screening device. In order to reduce the screening effort, the accept from the screening device is directed to the headbox of the machine, and the reject from the screening device is redirected upstream into a high-consistency flow.

15 Claims, 1 Drawing Sheet

SCREENING IN AN APPROACH FLOW SYSTEM

CROSS REFERENCE TO RELATED APPLICATIONS

This is a continuation of PCT application No. PCT/EP2009/064526, entitled "SCREENING IN AN APPROACH FLOW SYSTEM", filed Nov. 3, 2009, which is incorporated herein by reference.

BACKGROUND OF THE INVENTION

1. Field of the Invention

The invention relates to an arrangement to produce a fibrous stock suspension for the production of a paper, cardboard or tissue web or another fibrous web from at least one fiber—and filler material-containing high consistency flow in the approach flow section of a machine for the production of a fibrous web, whereby at least one high consistency flow is directed through at least one screening device.

2. Description of the Related Art

In the approach flow section of paper machines the high consistency accept consisting of fibers and fillers is diluted with the white water captured in the paper machine and directed to the headbox. The flows are hereby deaerated and for the purpose of cleaning are routed through a three-stage screening device. This is relatively complex.

It is therefore the objective of the current invention, and what is needed in the art is, to reduce the complexity of the cleaning without negatively affecting the quality of the fibrous web which is to be produced.

SUMMARY OF THE INVENTION

According to the invention the objective is solved in that, and the present invention provides that, the accept of the screening device is directed to the headbox of the machine, and the reject of the screening device is redirected, at least partially upstream into a high consistency flow. By redirecting the reject, the number of required screening devices in a respective flow can be reduced. Moreover, devices for cleaning or screening of the reject which was not redirected can be constructed substantially smaller than normal.

This is also made possible by the relatively great cleanness of the flow in the approach flow section which resulted through the quality improvement in the stock preparation. As a result of this the screening device fulfills merely a policing function.

Hereby, the cleansed flow of the screening device is referred to as "accept" and the rejected portion of the flow is referred to as "reject".

Especially in multilayer or multiply headboxes several high consistency flows could be necessary whereby then several high consistency flows are directed to the headbox and preferably each high consistency flow is directed through a screening device whose accept is directed to the headbox and whose reject is redirected upstream into a high consistency flow.

Use of this is especially advantageous at high stock consistencies of above 1.5%, especially of above 2.5%.

As a rule the high consistency flow is diluted to the required measure, before and/or in the headbox by mixing with a low consistency flow. For the purpose of cost reduction, the low consistency flow should be at least predominantly, preferably exclusively white water, in other words, particularly without or at least with only minimal addition of fresh water. Here it is advantageous if in the approach flow at least one low consistency flow is directed over one screening device to the headbox and the accept of the screening device is directed to the headbox of the machine and the reject of the screening device is redirected at least partially upstream into the low consistency flow.

This results in minimization of the screening effort in the same way as in the high consistency flow.

In each instance the screening device should be the last screening or cleaning device of the respective flow before the headbox, meaning that the accept is fed directly to the headbox.

Hereby it is often sufficient if the screening device is adjusted so that a maximum of 25%, preferably a maximum of 10% of the flow is rejected by the screening device.

For optimum utilization of the advantages the reject from the screening device should at least predominantly be directed into the flow flowing into the screening device.

This redirection can occur before the screening device or also at the inlet of same. Hereby it is advantageous if at least during the preponderant operating duration more than 80%, preferably more than 90% of the reject from the screening device are directed into the flow flowing into the screening device.

The cost saving is particularly significant if at least during the preponderant operating duration the entire reject from the screening device is directed into the flow flowing into the screening device. Whether this is possible depends on the quality requirements upon the fibrous stock suspension, and also on its type. Generally, first and foremost however, if the entire reject is redirected it can be advantageous for the outward transfer of accumulated contaminants to remove a portion of the reject, or the entire reject over a short time period from the system. These removal time periods can be arranged according to requirement, or at regular repetitive time intervals.

If the screening device is not sufficient an additional screening or cleaning device can be provided into which preferably a maximum of 20%, in particular a maximum of 10% of the reject from the screening device are directed. Due to the low flow rate, this screening or cleaning device can however be considerably smaller than normal.

Here it is advantageous if the accept from the additional screening or cleaning device is directed upstream into the flow and the reject is removed from the system.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
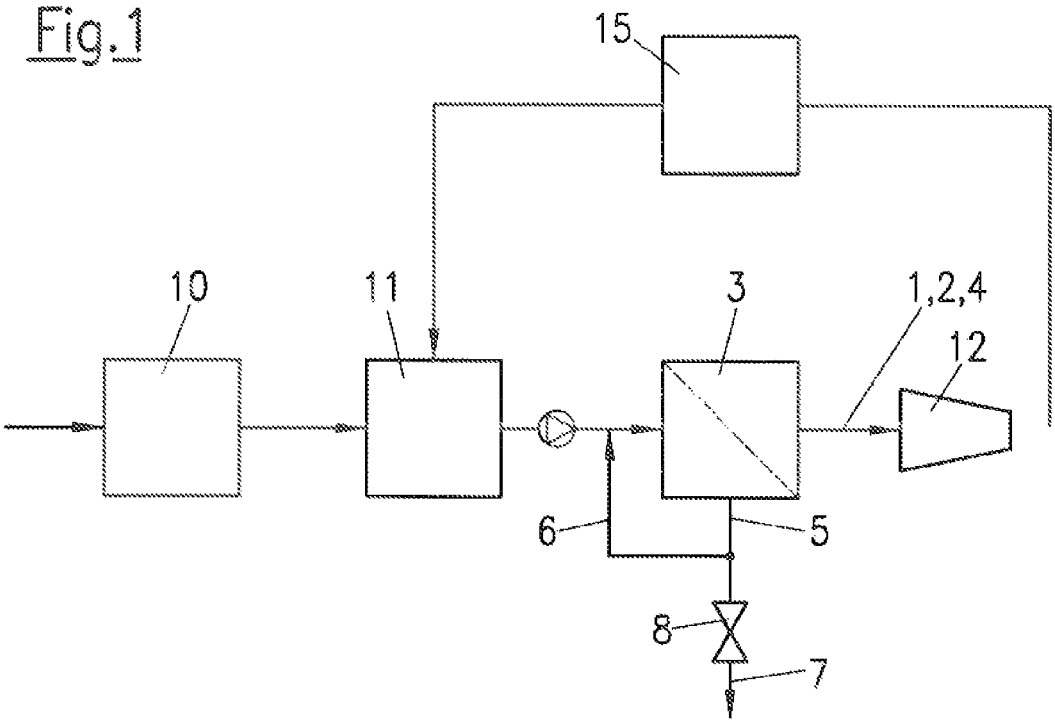
FIG. 1 is one single-stage screening device.

In the approach flow of the paper machine high consistency flow 1 consisting essentially, as is known, of fibers and fillers is combined and mixed in a mixing chest 10 according to the guidelines of the paper maker, that is to say mixed to predetermined mixing ratios.

Before this mixing chest 10 a high consistency flow 1 having a stock consistency of for example 3.5% is directed over a cleaning device 11 to a headbox 12. In said cleaning device 11 thinning to 0.5 to 2% occurs through the addition of white water.

Headbox 12 delivers the fibrous stock suspension over one or several nozzles onto a forming wire of a following former for sheet formation.

The generated white water is captured in the former as well as in the following units of the paper machine and redirected into the approach flow.

Utilization of white water to form a low consistency flow 2 is not only associated with savings compared to the use of fresh water, but the fibers and fillers contained in the white water can also be reused. The stock consistency of the white water is hereby at approximately 0.2%.

However, the captured white water contains a relatively large amount of air. This is why it is reduced to a content of free air of less than 1 volume % in a degassing device 15. For this purpose the degassing device 15 can be connected with a vacuum source which sucks the gas from the white water. However, centrifuges are also known for use in degassing.

For the necessary pressure build up at headbox 12, the high consistency flow as well as the low consistency flow 2 respectively are directed via a pump.

Pre-dilution of the high consistency flow 1 can for example occur over a mixing device described in DE 100 50 109 whereby the high consistency flow 1 is directed at 3-15 times the flow speed into the low consistency flow 2.

The already diluted high consistency flow 1 is combined with low consistency flow 2 in headbox 12. In order to be able to ensure uniform fiber distribution transversely to the paper machine, low consistency flow 2 is directed into a low consistency flow lateral distributor and the high consistency flow 1 is directed into a high consistency flow lateral distributor of headbox 12.

Both lateral distributors are usually formed by a tapered tube from which several partial flows branch off in direction of flow. The partial flow remaining at the narrow end of the lateral distributor is redirected into the approach flow of the paper machine in order to be reused. A lateral distributor of this type is described for example in EP 0029 905, and also in DE 10 234 559.

As described in EP 1 645 684 or DE 10 2004 049 261 headbox 1 can also comprise a control system for the base weight profile.

According to the two drawings the high consistency flow 1, as well as the low consistency flow 2 are directed through a cleaning device 11 to a screening device 3—here in the embodiment of a perforated or slotted screening device. Accept 4, that is to say flow 1, 2 flowing through the screening device 3 is routed directly to headbox 12.

Reject 5, that is to say the rejected portion of flow 1, 2 is at least predominantly directed through a return line 6 into flow 1, 2 flowing into the screening device 3. This recirculation may for example occur without pump, as described in EP 1262594.

Reject 5 is hereby formed by approximately 10-25% of flow 1, 2 flowing into screening device 3. Even at a higher level of contamination this reject volume also ensures a stable functioning of screening device 3.

In the arrangement illustrated in FIG. 1 the entire reject 5 is directed through return line 6 to the inlet of screening device 3. This eliminates additional screening devices 3, thereby making the line very efficient.

Due to the complete recirculation, accumulation of contaminants occurs which are removed from the system over a certain period of time at relatively large intervals of several hours or days.

For this purpose the return line 6 is equipped with a branch-off line 7 with a valve 8 which directs the accumulated contaminants to the drain.

Figure 2:
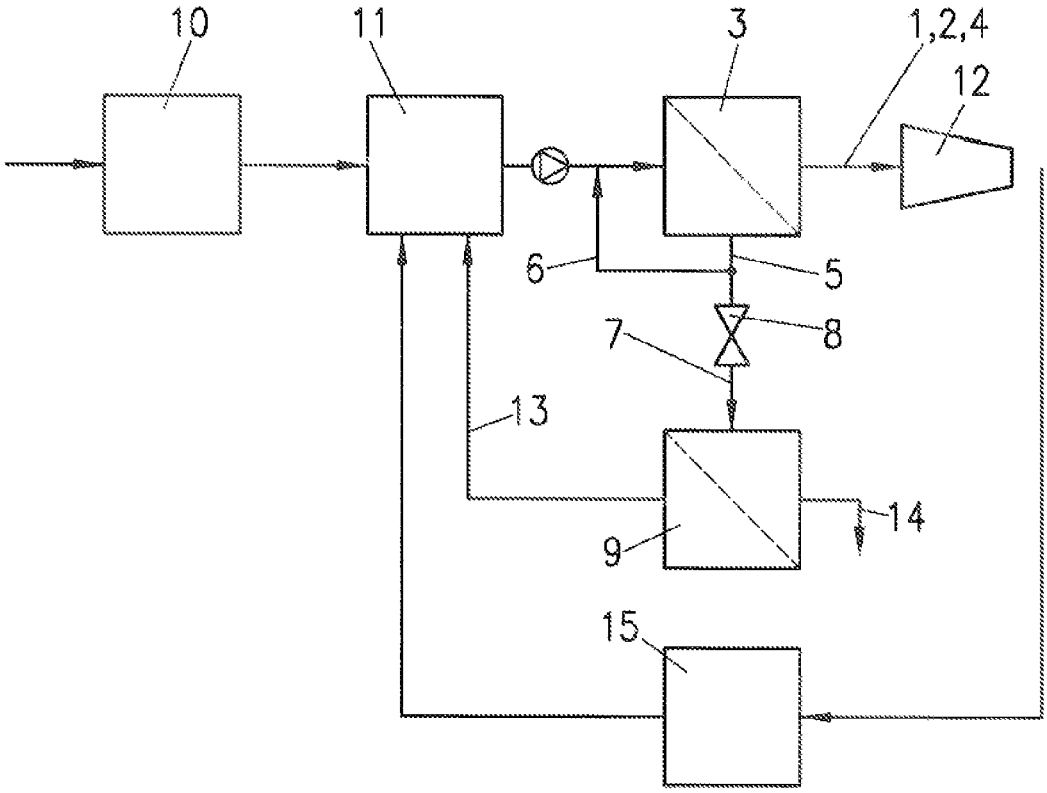
FIG. 2 is one two-stage screening device.

In contrast, the branch-off line 7 in the arrangement illustrated in FIG. 2 directs a portion of approximately 5 to 10% of reject 5 of screening device 3 into an additional screening or cleaning device 9.

Because of this low flow rate this can be designed accordingly smaller.

Reject 14 of this additional screening or cleaning device 9 is directed out of the system, and accept 13 is directed into cleaning device 11 of flow 1,2 or into degassing device 15 of the white water.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An arrangement to produce a fibrous stock suspension for a production of a fibrous web, which is one of a paper web, a cardboard web, and a tissue web, from at least one fiber and filler material containing a high consistency flow in an approach flow section of a machine for the production of the fibrous web, the machine including a headbox, said arrangement comprising:

at least one screening device through which at least one said high consistency flow is directed, an accept of said screening device being directed to said headbox of the machine, a reject of said screening device being redirected, at least partially, upstream into said at least one high consistency flow, said accept of said screening device being fed directly to said headbox without going through an additional screening device between said screening device and said headbox and without going through a cleaning device between said screening device and said headbox.

2. The arrangement according to claim 1, wherein a plurality of said high consistency flow are directed to the headbox, each one of said plurality of high consistency flows being directed through said screening device whose said accept is directed to the headbox and whose said reject is redirected upstream into at least one of said plurality of high consistency flows.

3. The arrangement according to claim 1, wherein in an approach flow at least one low consistency flow is directed over one said screening device to the headbox and said accept of said screening device is directed to the headbox of the machine and said reject of said screening device is redirected at least partially upstream into said at least one low consistency flow.

4. The arrangement according to claim 3, wherein a maximum of 25% of a flow including said at least one high consistency flow and said at least one low consistency flow is said reject from said screening device.

5. The arrangement according to claim 3, wherein a maximum of 10% of a flow including said at least one high consistency flow and said at least one low consistency flow is said reject from said screening device.

6. The arrangement according to claim 3, wherein said reject from said screening device is at least substantially directed into a flow flowing into said screening device and including said at least one high consistency flow and said at least one low consistency flow.

7. The arrangement according to claim 6, wherein at least during a preponderant operating duration more than 80% of said reject from said screening device is directed into said flow flowing into said screening device.

8. The arrangement according to claim 7, wherein at least during said preponderant operating duration more than 90% of said reject from said screening device is directed into said flow flowing into said screening device.

9. The arrangement according to claim 7, wherein at least during said preponderant operating duration an entire said reject from said screening device is directed into said flow flowing into said screening device.

10. The arrangement according to claim 6, wherein one of said reject of said screening device and a portion thereof is discharged from the arrangement over a plurality of short and regularly repetitive time periods.

11. The arrangement according to claim 6, further including one of an additional screening device and a cleaning device, wherein a portion of said reject of said screening device is directed into one of said additional screening device and said cleaning device.

12. The arrangement according to claim 11, wherein a maximum of 20% of said reject of said screening device is directed into one of said additional screening device and said cleaning device.

13. The arrangement according to claim 11, wherein a maximum of 10% of said reject of said screening device is directed into one of said additional screening device and said cleaning device.

14. The arrangement according to claim 11, wherein an accept from one of said additional screening device and said cleaning device is directed upstream into said flow.

15. The arrangement according to claim 11, wherein a reject from one of said additional screening device and said cleaning device is removed from the arrangement.

* * * * *